US005165725A

United States Patent [19]

Gollon

[11] Patent Number: 5,165,725

[45] Date of Patent: Nov. 24, 1992

[54] TWO-PANEL TAMPER-INDICATING TAG

[76] Inventor: Peter J. Gollon, 15 Eleanor Pl., Huntington, N.Y. 11743

[21] Appl. No.: 645,578

[22] Filed: Jan. 25, 1991

[51] Int. Cl.[5] ..... B42D 15/00

[52] U.S. Cl. ..... 283/81; 283/80; 283/108

[58] Field of Search ..... 283/80, 81, 108

[56] References Cited

U.S. PATENT DOCUMENTS

| | | | |
|---|---|---|---|
| 1,291,382 | 1/1919 | Bohan | 281/28 X |
| 3,228,129 | 1/1966 | Gwinn et al. | 283/80 X |
| 4,666,185 | 5/1987 | Pilborough | 283/80 |
| 4,826,213 | 5/1989 | Matsuguchi et al. | 283/108 |
| 4,856,819 | 8/1989 | Gollon | 283/81 X |
| 4,865,352 | 9/1989 | Gollon | 283/81 X |

*Primary Examiner*—Paul A. Bell
*Attorney, Agent, or Firm*—Ladas & Parry

[57] ABSTRACT

A two-panel tamper-indicating tag is disclosed suitable for use on irregular shaped objects, such as rings, etc. The tag does not leave adhesive residue on the object because the two panels are adhesively secured together and attached to the object by means of a loop, one end of which is attached to each panel. Attempts to fradulently remove and reuse the applied tag are defeated by the use of an adhesive on the panels which can not be reused [a stick only once type adhesive]. In another embodiment of the tag, the adhesive used on the panels is of the type which changes color as it is stretched. This color change will be visible when the two panels are adhered together again, indicating that the tag has been removed and reattached.

4 Claims, 3 Drawing Sheets

TWO-PANEL TAMPER-INDICATING TAG

BACKGROUND OF THE INVENTION

The invention relates to a security or tamper-indicating tag, i.e. a tag that indicates that it has been removed after an initial application to an item. More particularly, it relates to a tamper-indicating tag having two panels that adhere to each other, and a strap that encircles a portion of the object being labelled.

Tags having two indicia-receiving panels that adhere to each other are well known. One particular type of two-panel tag has a strap made of the same material as the two tag panels. This strap extends between the tag panels to automatically form a loop about an item, such as a ring, when the two panels are adhered to each other. A similar tag (commonly known as a "rat-tail") has two panels foldably connected to each other and a tail of the same material projecting from one end on one of the panels. The opposite, initially free, end of the tail forms a loop when it is placed between the panels before they are adhered to each other.

Single-panel tamper-indicating tags are also known. The indicia-receiving panels of such tags have more than one layer. The layers are chosen so that, after the panel is adhered to an item, the layers will delaminate when the tag is removed. This delamination either destroys the tag layer carrying the indicia with which the tag labelled the item, or visibly defaces the indicia layer.

Such tamper-indicating tags have many uses. Their most common use involves the permanent placement of a manufacturer's serial number, warranty, or other identification upon an item. Anyone wishing to transfer the tag to another item would find this task impeded by the delamination of the tamper-indicating tag, with some layers being removed while others remain behind, still adhered to the original item.

The use of particular interest here is as a price tag, to prevent customers from switching a tag marked with a lower price indicia from one item to another item of higher price.

Because such single-panel tamper-indicating tags are adhered to the item, they are not as suitable for use with small or irregularly shaped items, such as rings, for example, as are two-panel tags.

A further disadvantage exists when a single panel tamper-indicating tag is used for purposes like price marking which ordinarily require complete removal of said tag. The removal of a one-panel tamper-indicating tag necessarily leaves a portion of the tag, including some adhesive, on the item when the tag delaminates upon removal. This residue is undesirably messy and difficult to remove.

SUMMARY OF THE INVENTION

It is an object of this invention to provide a two-panel tamper-indicating tag and, particularly, one suitable for use with small or irregular objects.

It is another object of this invention to provide a tamper-indicating tag which does not leave any adhesive residue on an object to which it has been attached.

The present invention achieves both of these objects by providing a two panel tag with at least one tamper-indicating panel and a loop for attaching the tag to an item by passing the loop around the item, the loop being held closed by mutual adhesion of the two panels of the tag.

Also, detecting the illicit re-use of a two-panel tamper-indicating tag is harder than for a one panel tamper-indicating label. This is because, in the one panel case, the portion of the label left behind on the object originally labelled is not available for use on the object being illicitly labelled. The lack of the missing portion is evident when the re applied portion is examined. However, in the two panel case, the illicitly opened tag need only be re-adhered to itself, but with its loop portion around another object. Thus, the user of such a tamper evident tag cannot rely on a portion of the tag being missing in order to detect the surreptitious re-use of the tag. A different tamper-indicating mechanism is required.

The present invention thus also allows for two such tamper-indicating mechanisms. In the first such mechanism ("stick only once"), the multi-layered, self-adhesive tag delaminates upon opening in such a way that an insignificant amount of the original adhesive is exposed, so the tag cannot hold itself closed a second time.

In the second such mechanism ("contrasting color"), the opening of the tag causes the adhesive to first stretch and thus be deformed before the tag delaminates. As a result of this deformation, some of the fragments of the delamination are no longer able to line up with their original positions when the tag is reclosed. Thus the reclosing of the tag causes gaps to appear in previously uniform coloring on the tag; an underlying adhesive layer of a contrasting color is then visible through the gaps.

BRIEF DESCRIPTION OF THE DRAWING

Preferred embodiments that illustrate but do not limit the invention will now be described with reference to the drawing, in which.

DESCRIPTION OF THE PREFERRED EMBODIMENTS

It should be noted that other tag configurations are possible under the claims of this invention, and that not all of the layers shown in these preferred embodiments are necessary for the tamper-evident tag to function as described in the claims of this invention.

The first preferred embodiment ("stick only once") is shown in FIGS. 1 through 5 in a known configuration suitable for labelling rings (commonly known as a "ring tag"). The two panels 1, 2 are at opposite ends of a strap 3 that connects them. Printed indicia at 4 are shown on the top surfaces of the tag. The tag is shown temporarily adhered to a release sheet 5 on which tags are often manufactured, stored, or printed prior to use.

Figure 2:
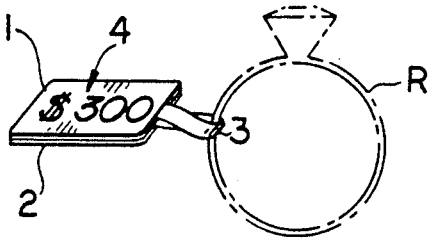
FIG. 2 shows the tag of FIG. 1 assembled around a ring.

The tag is assembled and attached to an item, such as a ring R, by folding the strap 3 about the item, and adhering the two panels 1 and 2 to each other, thus forming the strap into a loop around the item, as shown in FIG. 2.

Figure 3:
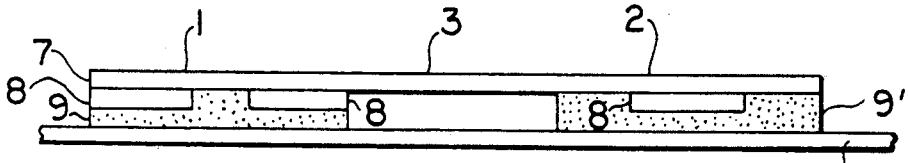
FIG. 3 is an enlarged longitudinal elevation of the tag of FIG. 1.

Each panel 1,2 is constructed of three layers, as shown in FIG. 3: a top layer 7 of flexible plastic such as Mylar, which also forms the strap 3; a here discontinuous layer of release agent 8, and a layer of pressure sensitive adhesive 9 and 9' The tag is shown in its temporary position on the release sheet 5.

Figure 4:
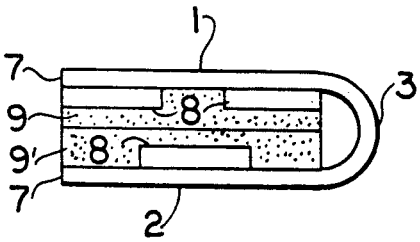
FIG. 4 is an enlarged elevation of the tag of FIG. 3 assembled like the tag of FIG. 2.

As is shown in FIG. 4, the release agent 8 is applied in such a longitudinally discontinuous pattern that, at least when the tag is assembled by having its two panels adhered to each other, there is release agent 8 between substantially each point in the adhesive and the underside of at least one panel. This release agent is chosen to have minimal or no re-adhesion to the plastic layer 7 once it has dried and been separated from that layer. Such release agents are known to practitioners of the label fabrication art.

Figure 5:
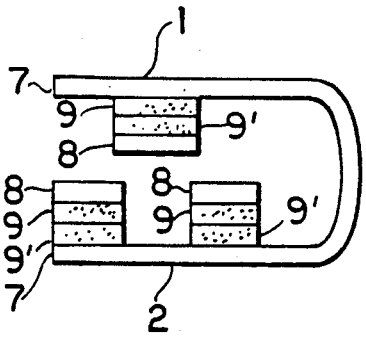
FIG. 5 shows the same view as FIG. 4, but after the tag panels have been separated.

When the tag is then re-opened, it delaminates at the bond between the release agent 8 and the plastic layer 7, as shown in FIG. 5. Only a minimal amount of the adhesive 9 or 9' is then exposed (not shown) peripherally or at pattern misalignments, for example, to reseal the tag; the remainder of the adhesive 9,9' is covered by the release agent 8. Thus after opening, the tag will not hold itself together again securely, or at all.

The proper functioning of the tag thus depends on the relative strength of adhesion of the different layers. The relative adhesion between the various layers must be as follows:

Least adhesion: Between the adhesive 9,9' and the release sheet 5 on which the unassembled tag may be prepared, distributed, printed or stored.

Next greater adhesion: Between the release agent and the plastic tag body 7.

Greatest adhesion: between the two layers of adhesive 9 and 9' under the two panels of the tag; and between the release agent 8 and the adhesive 9, 9'.

A second preferred embodiment is shown in FIGS. 6–13. This embodiment is in the known form of a "rat tail tag", and reveals tampering by having portions of the illicitly reassembled tag show a contrasting color from the rest of the tag face.

Figure 6:
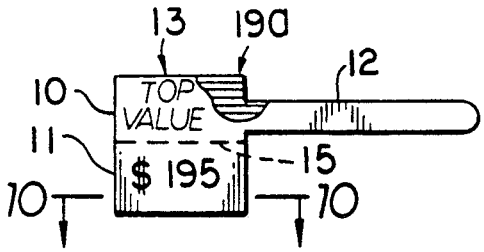
FIG. 6 is a plan view of a flat, unassembled "rat tail" tag of a second preferred embodiment, employing the "contrasting color" tamper-indicating mechanism.

FIG. 6 shows a plan view of the flat, unassembled tag, comprising two planar panels 10 and 11 and a tail 12 connected at one end to one of the panels. Normally these tags would be produced or distributed adhered to a release sheet, as is known in the art, said release sheet not being shown here. The two panels are connected by a fold line 15. Indicia at 13 are shown printed on the top surface of the panels.

Figure 7:
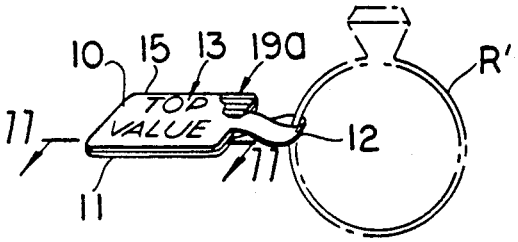
FIG. 7 shows the tag of FIG. 6 assembled around a ring.

FIG. 7 shows the tag of FIG. 6 after it has been assembled about an item such as a ring R', by having the tag's tail 12 passed through the ring, and then looped back so that it lies underneath the bottom of panel 10. Panel 11 is then folded along fold line 15 so that the backs of the two panels 10 and 11 mutually adhere by virtue of the pressure sensitive adhesive (20 in FIG. 8) on their back surfaces. The free end of the tail 12 is then captured and held by this same adhesive, thus forming the tail into a loop which encircles the ring R' to be labelled.

Figure 8:
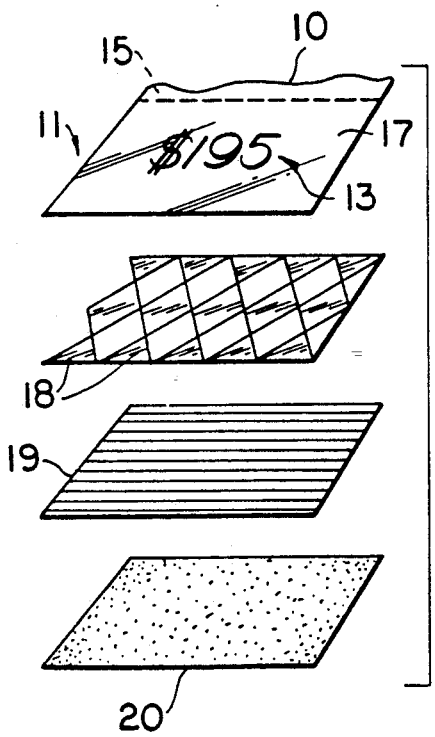
FIG. 8 is an enlarged schematic exploded perspective view of a portion of the tag of FIG. 6.

FIG. 8 shows an exploded view of the various layers comprising panel 11. In sequence, these layers are:

A clear (preferably transparent, but at least translucent) flexible plastic 17 such as Mylar which is able, or has been treated by known processes to enable it to receive printing of the indicia at 13.

A layer of release agent 18 applied in a pattern which covers a portion of the underside (opposite the indicia at 13) of the clear plastic 17. Release agents suitable for this use are known to practitioners of the label fabrication art. This release agent is clear, like the plastic 17, and is here shown so shaded to illustrate the pattern of application;

A layer 19 of opaque ink covers the underside of the clear plastic 17 and the release agent 18. Opaque inks are known to practitioners of the label fabrication art. In this preferred example, the ink is blue, as indicated. A layer of plastically stretchable opaque pressure sensitive adhesive 20 covers the ink 19 and has a color contrasting with that of the ink 19; here the color is white. The need for, and nature of the necessary stretchable properties of the adhesive will become evident in the later discussion. Avery's white acrylic adhesive known to the trade as "P9" is satisfactory for this purpose.

It is intended that when the tag is assembled and subsequently opened, said opening will be revealed by the manner in which the assembled tag delaminates. The proper functioning of the tag thus depends on the relative strength of adhesion of the different layers relative to each other, and to the elasticity of the adhesive 20. In those regions where the release agent is present, delamination must occur at the release agent 18 between the plastic tag body 17 and the colored ink 19. It does not matter what proportion of the release agent remains adhered to the plastic body 17 and what proportion to the colored ink 19; here all the release agent is shown adhering to the colored ink 19. In areas where the release agent is not present, the two panels of the tag must separate at the boundary between their respective adhesive layers without delamination occurring. Thus the relative adhesion between the various layers must be as follows:

Least adhesion: Between the adhesive 20 and the release sheet (not shown) on which the unassembled tags may be prepared, distributed, printed or stored.

Next greater adhesion: Between the ink 19 and the release agent 18 or between the release agent 18 and the plastic tag body 17;

Next greater adhesion: between the two layers of adhesive 20, **20*a*** under the two panels when they are adhered to each other in the assembled tag;

Greatest adhesion: between the ink 19 and the lower surface of the plastic tag body 17 in those regions where the release agent is not present.

The uniform blue color of the initially assembled tag may be clearly seen in the enlarged view of the tag shown as FIG. 7 and at **19*a* in FIGS. 6 and 7**.

Figure 10:
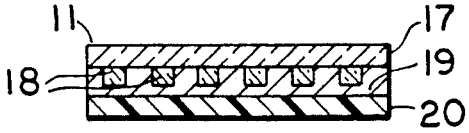
FIG. 10 is a cross sectional view of the tag of FIG. 6, along the section X—X.

A cross section of the unassembled tag of FIG. 6 along the section X—X, is shown in FIG. 10. The vertical scale is exaggerated for clarity. The assembled tag of FIG. 7 is shown in cross section in FIG. 11. Layers 17*a*, 18*a*, 19*a* and 20*a* correspond to those shown in FIGS. 8 and 10. Adhesive layer 20*a* is the adhesive on the plastic layer 17*a* forming the body of panel 10. It is shown adhering to adhesive layer 20 of panel 11. The corresponding intermediate layers of release agent 18*a* and opaque ink 19*a* are also shown.

Figure 9:
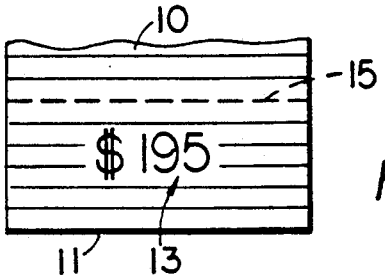
FIG. 9 is an enlarged plan view of a portion of the tag of FIG. 7.
Figure 11:
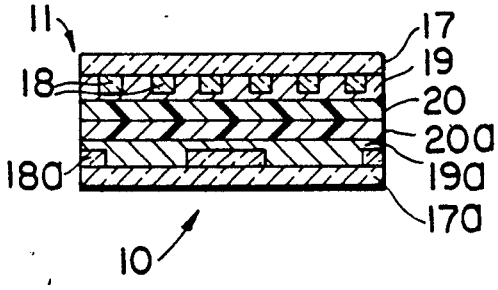
FIG. 11 is an enlarged longitudinal elevation of a portion of the tag of FIG. 7 in cross section along section line XI—XI of FIG. 7.
Figure 12:
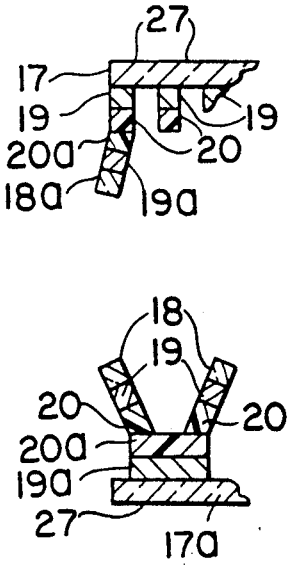
FIG. 12 shows a portion of the same cross section as FIG. 11, but after the tag has been opened.
Figure 13:
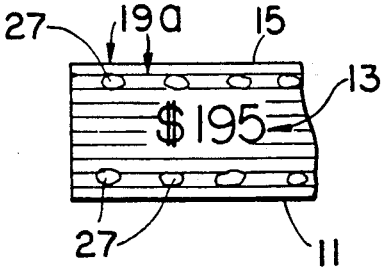
FIG. 13 shows the same view as FIG. 9, but after the tag has been opened and resealed.

After opening, a portion of the partially delaminated tag is shown in FIG. 12, in the same relative position as in FIG. 11. In those areas where the tag has delaminated at the release agent 18, 18*a* gaps 27 appear in the layers of opaque ink 19, and 19*a* and contrasting colored adhesive 20 and 20*a*. The portions of adhesive 20,20*a* which were removed from these gaps have been permanently stretched in different directions; these portions carry with them the fragments of opaque ink 19, 19*a* which was removed during delamination. It will be observed that because of this stretching, the removed portions of adhesive 20, 20*a* and ink 19, 19*a* no longer line up with the voids 27 in the opposite panel from which they were removed. Thus, if the tag is reclosed, portions of the white adhesive 20, 20*a* will be visible through the voids 27 when viewed through either outside surface of the tag. This is shown clearly in FIG. 13, in which random patches of white appear at voids 27 in the previously all blue background of the tag, as shown in FIG. 9. These white patches are the indication that the tag has been tampered with.

Two preferred embodiments have been described above. Each tag had a different physical layout, and two different tamper-indicating mechanisms were described. Each tamper indicating mechanism can be used with either of the two two-panel tag configurations described, or with other two-panel configurations not described.

Figure 1:
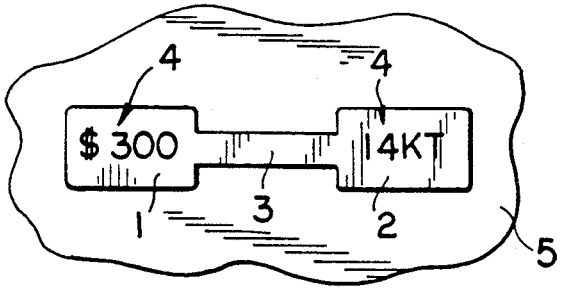
FIG. 1 is plan view of a flat, unassembled preferred ring tag made with the "stick only once" tamper-indicating mechanism, with its printed side up.

I believe that the single best embodiment currently available consists of the "ring tag" configuration shown in FIG. 1, combined with the "contrasting color" tamper-indicating mechanism described above.

I claim:

1. A two-panel tamper-indicating tag comprising:

two planar panels, each panel having opposite top and bottom surfaces, the top surface of at least one of the panels being for receiving information indicia, whereby a price may be printed thereon;

attaching means connecting the panels for forming a loop about a portion of an object to be labeled with the information indicia; and tamper-indicating means on a bottom surface at least one of the panels for sticking only a first time to the bottom surface of the other of the panels, whereby to close the loop and label the object with the information indicia, but not sticking thereto by itself a second time after having been separated from the first-time sticking, the tamper-indicating means comprising the two panels, wherein:

(a) at least one of the panels has the following sequentially layered construction;

a first layer having the top surface of the one panel and an opposite bottom surface of the first layer; and a second layer of release agent covering at least part of the bottom surface of the first layer in a first pattern, the release agent having minimal or no re-adhesion to the first layer once it has been separated from that layer; and (b) an adhering layer of pressure sensitive adhesive for the sticking, the adhering layer covering at least part of at least one of the first and second layers and the bottom surface of the other of the two panels in a second pattern;

wherein the first and second patterns are such that, when the two panels are first stuck to each other, there is release agent between each point in the adhering layer and the bottom surface of at least one of the panels;

and wherein all of the layers have some adhesion selected so that the least adhesion between any two of the layers occurs between the second, release agent layer and the bottom surface of the first layer; and the greater adhesion occurs between the second, release agent layer and the adhering layer.

2. The tag of claim 1, and further comprising a release sheet covering the adhering layer only before the first-time sticking with the adhesion between the adhering layer and the release sheet being less than the adhesion between any of the other layers.

3. A two-panel tamper-indicating tag comprising:

two planar panels, each panel having opposite top and bottom surfaces, the top surface of at least one of the panels being for receiving information indicia, whereby a price may be printed thereon;

attaching means connecting the panels for forming a loop about a portion of an object to be labeled with the information indicia; and tamper-indicating means on a bottom surface at least one of the panels for sticking a first time to the bottom surface of the other of the panels, whereby to close the loop and label the object with the information indicia, and after being separated from the first-time sticking and stuck a second time to the bottom surface of the other of the panels, showing areas of a second color that contrasts with a first color visible on the top surface of the one panel, the tamper-indicating means comprising the two panels, wherein:

(a) at least one of the panels has the following sequentially layered construction;

a first, at least translucent layer having the top surface of the one panel and an opposite bottom surface of one of the two panels being intended to receive printed information, such as the first layer;

a second layer of release agent covering only part of the bottom surface of the first layer and not covering other parts, the release agent being at least sufficiently translucent relative to the translucence of the first layer so as to be substantially invisible when seen through the top surface of the one panel; and a third layer of a coloring agent covering at least part of at least one of the bottom surface of the first layer and the second layer thereon, the coloring agent having sufficient color to be visible through the first and second layers; and (b) an adhesive layer of pressure sensitive adhesive for the stickings, the adhering layer covering at least part of at least one of the third layer and the bottom surface of the other of the two panels, the adhering layer having a noticeably different and contrasting color from the coloring agent sufficiently to be visible through first and second layers and deformability and stretchiness, so that it will stretch during the separation sufficiently to remain deformed by at least by approximately 1/32 of an inch after the separation;

wherein all of the layers have some adhesion selected so that the least adhesion between any two of the layers occurs one of between the second, release agent layer and the first, translucent layer or between the second, release agent layer and the third, coloring agent layer; the next greater adhesion occurs one of between the third, color agent layer and the adhering layer; and the greatest adhesion occurs between the third, coloring agent layer and the bottom surface of the first, translucent layer in those parts thereof not covered by the second, release agent layer.

4. The tag of claim 3, and further comprising a release sheet covering the adhering layer only before the first-time sticking with the adhesion between the adhering layer and the release sheet being less than the adhesion between any of the other layers.

* * * * *